United States Patent [19]

Babitz

[11] Patent Number: 4,637,583

[45] Date of Patent: Jan. 20, 1987

[54] DEVICE FOR POSITIONING PICTURE HANGERS ON A WALL SURFACE

[76] Inventor: Jeffrey M. Babitz, P.O. Box 805, West Dover, Vt. 05356

[21] Appl. No.: 687,593

[22] Filed: Dec. 31, 1984

[51] Int. Cl.[4] ..... F16M 13/00

[52] U.S. Cl. ..... 248/544; 33/180 R; 33/189; 248/497; 248/547

[58] Field of Search ..... 248/544, 546, 547, 548, 248/549, 497, 498, 489; 33/180 R, 189

[56] References Cited

U.S. PATENT DOCUMENTS

| | | | |
|---|---|---|---|
| 961,616 | 6/1910 | Johnson | 248/497 |
| 2,723,815 | 11/1955 | Browning | 248/497 X |
| 2,943,830 | 7/1960 | Anderson | 248/498 |
| 3,226,065 | 12/1965 | Smith | 248/547 X |
| 3,300,173 | 1/1967 | Kennedy | 248/546 |
| 3,516,165 | 6/1970 | Pfeffer | 248/544 |
| 3,599,686 | 8/1971 | Peebles | 248/497 X |
| 4,283,034 | 8/1981 | Seehan | 248/546 X |
| 4,455,756 | 6/1984 | Greene | 248/547 X |

*Primary Examiner*—J. Franklin Foss
*Assistant Examiner*—David L. Talbott
*Attorney, Agent, or Firm*—Thomas R. Morrison

[57] ABSTRACT

A device for the positioning and hanging of a picture frame or other object upon a wall includes a hanger member, an elongated locator member, and means detachably coupling the upper end of the hanger member to the lower end of the locator member. The hanger member is formed with on or more nail chutes which serve the dual function of suspending the support wire of the picture frame and receiving nails for securing the hanger member to the wall. The hanger member is also provided on its rear surface with a pressure-sensitive adhesive for temporarily mounting the hanger member on the wall. The position of the hanger member is located by hanging the picture frame on the hanger member while the latter is coupled to the locator member, and grasping the projecting locator member above the top edge of the picture frame to move the picture frame to a selected position on the wall. With the frame in its selected position, the hanger member is pressed against the wall, causing it to adhere temporarily at the selected location, after which the picture frame and locator member are removed and the hanger member is affixed permanently to the wall by insertion of nails through the nail chutes, and is precisely located to support the picture frame in its pre-determined selected position.

12 Claims, 7 Drawing Figures

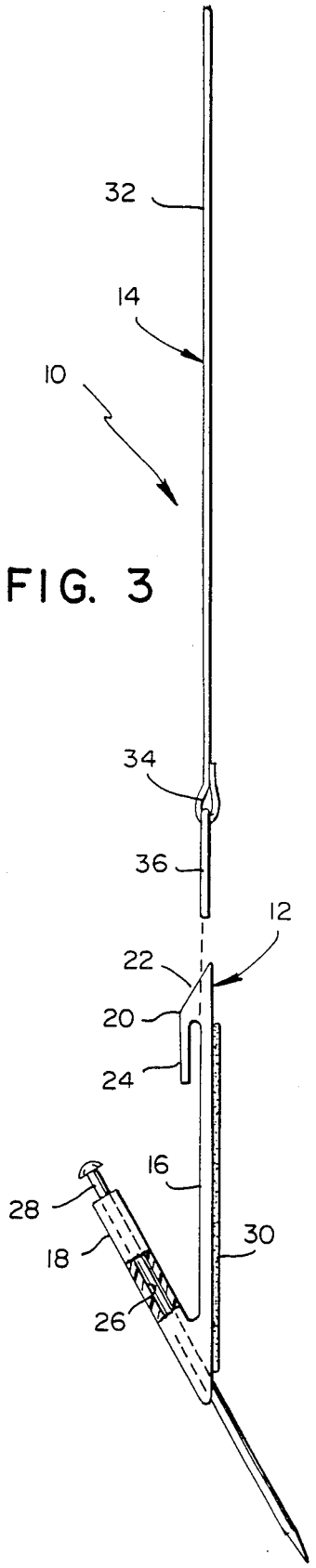
FIG. 3
FIG. 1
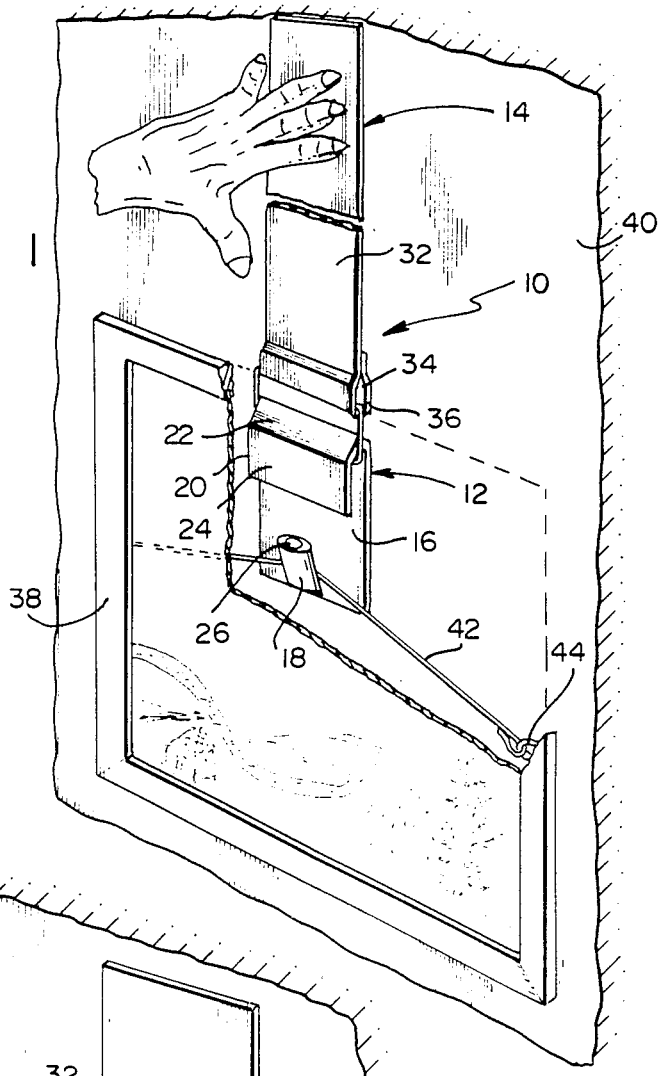
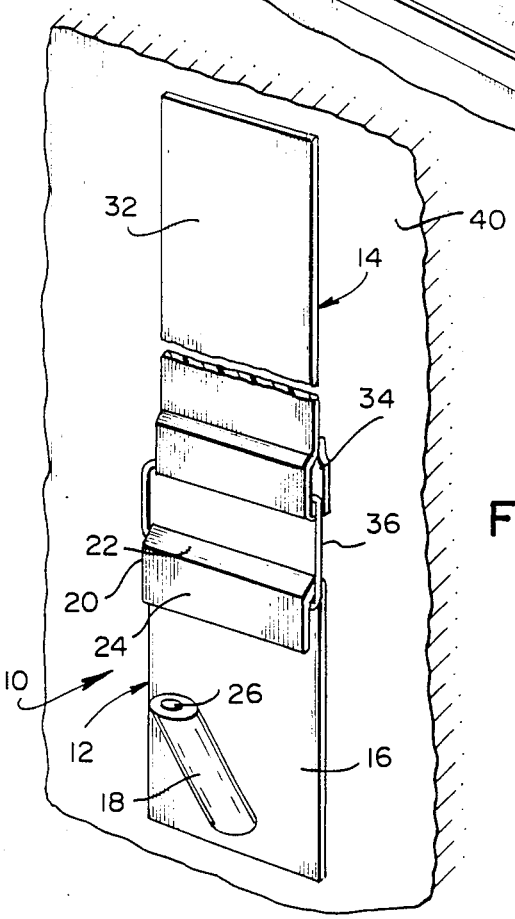
FIG. 2

DEVICE FOR POSITIONING PICTURE HANGERS ON A WALL SURFACE

BACKGROUND OF THE INVENTION

The present invention relates to novel and improved means for locating and positioning hanger units on a wall surface in precise selected positions for the mounting of pictures, mirrors, frames, and other articles.

It is well recognized that the positioning of hanging devices such as hanger hooks or nails on the surface of a wall is a difficult and time consuming procedure. In the hanging of pictures or other articles on a wall, the user manually places the picture against the wall and moves it to the desired position with relation to other pictures being hung, or, if alone, at the desired height and horizontal location. Having found the desired proper position, the difficulty arises in securing the nail or hanger member on the wall in the precise location required to support the picture in its selected position. The picture must first be removed from the wall, and the position of the nail or hanger member determined by estimation. This is made even more difficult when the picture frame is provided with the usual supporting wire extending transversely across its rear surface and having slack which determines the location of its point of attachment.

Present methods for accomplishing the task of precise picture hanging involve complicated and time-consuming procedures of measurement and marking of the wall surface, including estimates of the appropriate positioning of the hanging member, taking into account the size and shape of the picture or other article to be hung.

Attempts to solve this problem are exemplified in U.S. Pat. Nos. 3,516,165, 4,220,309, 4,241,510 and 4,382,337. These patents disclose methods and devices for hanging pictures in which a picture is suspended on a locating device and moved to a desired position on a wall, and the wall is then marked or punctured to indicate where the nail or hanger member is to be mounted. Such methods may result in inaccurate positioning of the hanger member and undue damage to the wall.

It is an object of the present invention to provide a method and device for positioning a hanging member on a wall in a precise location determined by pre-positioning the picture or other object to be hung in a selected location.

Another object of the invention is the provision of a device of the character described which is composed of two members: a picture hanger member and an elongated locator member which is detachably coupled to the hanger member. The article to be hung, such as a picture frame, is suspended upon the hanger member and the locator member is then grasped and moved along the wall until the picture frame is in the desired location for hanging. An adhesive layer on the rear side of the hanger member is then used to temporarily mount the hanger member to the wall and the picture frame and locator member are removed from the mounted hanger member which is then permanently affixed to the wall by nails or screws. When the picture frame is now hung from the hanger member, it is in precisely the selected position which it originally occupied.

A further object of the invention is to provide a device of the character described which is easy to use, of simple construction, and economical to manufacture.

SUMMARY OF THE INVENTION

In accordance with the invention, there is provided a device for positioning pictures and like articles in selected locations for hanging upon a wall, which device comprises a hanger member and an elongated locator member. The hanger member comprises a flat body plate and one or more nail chutes projecting angularly upward from the front surface of the body plate. The nail chute is sized and positioned to receive and hold the supporting wire of the picture frame to be hung on the wall. The elongated locator member has a length appreciably greater than the height of the hanger member so that when the picture frame is hung on the hanger member by means of its supporting wire, the coupled locator member projects well above the top of the picture frame and may be grasped by the user for locating the picture frame in a selected position for hanging on the wall. Adhesive means, preferably a layer of pressure-sensitive adhesive is located on the rear surface of the hanger member so that after the picture frame is located in the desired position, the hanger member is merely pressed against the wall, causing it to temporarily adhere thereto, after which the picture frame is removed. The device is also provided with means for detachably coupling the locator member to the upper end of the hanger member so that the locator member may now be uncoupled from the hanger member, leaving the latter temporarily adhering to the wall. The hanger member may now be permanently secured to the wall by driving nails or the like through the nail chute, and when the picture frame is hung thereon, it is located precisely in the selected position previously determined.

In one embodiment, the hanger member annd locator member are made as separate elements and the detachable coupling means constitutes a loop or ring on the locator member and a hook element at the top of the hanger member. This enables the locator member to be reused for locating a large number of separate hanger members. In another embodiment, the locator member is formed as integral continuation of the hanger member and the detachable coupling means constitutes a transverse notch or score line at the juncture of the members, so that the locator member may be bent and broken off along the score line. The separated locator member is then discarded, but the integral formation of the members enables the device to be molded as a single unit for economy in manufacture.

Additional objects and advantages of the invention will become apparent during the course of the following specification when taken in connection with the accompanying drawings in which:

BRIEF DESCRIPTION OF THE DRAWINGS

FIG. 1 is a perspective view of hanger positioning device made in accordance with the present invention, showing the manner in which the device is used for locating a picture frame upon a wall;

FIG. 2 is an enlarged perspective view of the device shown in FIG. 1, with the picture frame removed from the hanger member;

FIG. 3 is an exploded side elevational view of the hanger device of FIG. 1, showing the locator member detached from the hanger member, and showing a nail inserted through the hanger member;

DESCRIPTION OF THE PREFERRED EMBODIMENTS

Figure 4:
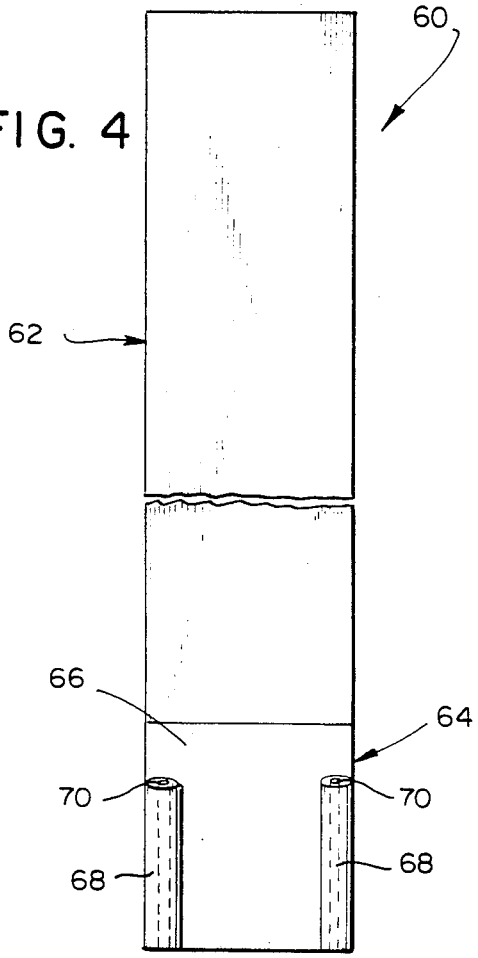
FIG. 4 is a front plan view of a second embodiment of hanger positioning device in which the hanger member is formed integrally with the locator member.

Referring in detail to the drawings, a first embodiment of hanger locator device 10 made in accordance with the present invention is shown in FIGS. 1-3. The device 10 comprises a picture hanger member 12 intended to be mounted on a wall for suspending the wire of a picture, mirror or other article, and a separate locator member 14 which is attachable to the hanger member.

The hanger member 12 is a unitary unit comprising a flat body plate 16 having a cylindrical nail chute 18 centrally located at the lower end thereof, and an angular hook 20 at the upper end thereof. The hanger member 12 is preferably made of a rigid plastic molded in one piece, with the nail chute 18 and hook 20 formed integrally with the body plate 16. The hook 20 is formed with an inclined upper surface 22 and a depending lip 24. The nail chute 18 extends upwardly at an angle of approximately 45 degrees from the plate 16, and has a through bore 26 sized to receive a nail or screw 28 (FIG. 3) for securing the hanger member 12 to a wall. A layer of pressure-sensitive adhesive 30 is coated on the rear surface of the body plate 16.

The locator member 14 comprises an elongated strap 52 of flexible material terminating in a loop 34 mounting a rectangular metal ring 36 which is sized to receive and support the hook 20 of the hanger member 12. The metal ring 36 and hook 20 serve as means for detaching the locator member 14 from the hanger member 12 after the latter has been properly located and mounted on a wall in a manner to be presently described.

FIG. 1 illustrates the manner in which a picture frame 38 is located on a wall 40 by means of the hanger locator device 10. The picture frame 38 is provided with the usual supporting wire 42 extending horizontally across the rear of the frame and secured to eyelets 44 mounted on the frame 38 at points above the center thereof. In use, when a picture is to be located in a selected position for hanging, the hanger member 12 is attached to the bottom of locator member 14 by inserting the hook 20 into the metal ring 36 as shown in FIG. 2. With the hanger member suspended at the bottom of strap 32, the picture frame 38 is hung upon the hanger member 12 by placing the wire 42 over the nail chute 18 of the hanger member in the manner shown in FIG. 1. The elongated strap 32 is made appreciably longer than the hanger member 12, being at least three times the length of the latter, so that when the picture frame 38 is hung upon the hanger member 12, the locator member 14 projects well above the top edge of the picture frame in a position to be grasped by the user.

The user now grasps the projecting upper end portion of the elongated strap 32 and brings it as well as the suspended hanger member 12 and mounted picture frame 38 against the wall 40, moving it until the picture frame is properly located in the desired position for hanging, which position may be readily determined visually.

When the picture frame 38 is located in the desired position for hanging, the user merely presses the picture frame inwardly toward the wall 40 until the hanger member 12 at the rear of the picture frame is pressed firmly against the wall, thereby causing the layer of pressure-sensitive adhesive 30 to adhere to the wall. The picture frame 38 is then removed from the hanger member 12, and the locator member 14 then uncoupled from the hanger member hook 20 and removed, leaving the hanger member 12 temporarily adhering to the wall 40 in its proper position for hanging the picture. The nail 28 is then inserted through the bore 26 of the nail chute 18 and hammered into the wall to secure the hanger member 12 firmly to the wall. The picture frame 38 may now be hung upon the inclined nail chute 18 of the hanger member 12, and will be supported thereby in the exact selected position.

Figure 6:
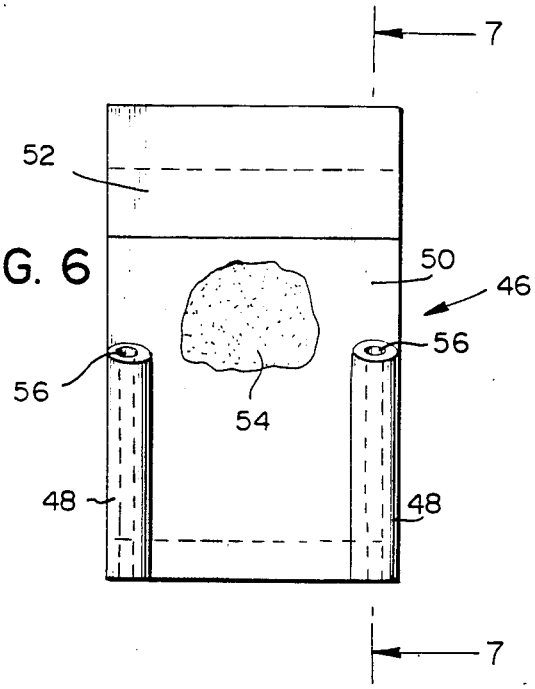
FIG. 6 is a front plan view of a separate hanger member forming part of the device of FIGS. 1 to 3, which hanger member is provided with a pair of spaced nail chutes.
Figure 7:
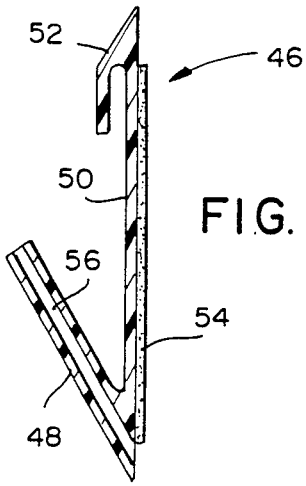
FIG. 7 is a sectional view taken along line 7—7 of FIG. 6.

FIGS. 6 and 7 show a modified type of hanger member 46 which is similar to the hanger member 12 previously described, except that it is provided with a pair of spaced nail chutes 48 and serves as a heavy duty hanger for large or heavy pictures, mirrors and the like. The hanger member 46 again has a flat body plate 50 having an angular hook 52 at its top end and a layer of pressure sensitive adhesive 54 on its rear surface. The nail chutes 48 are formed at opposite sides of the body plate 50, as shown in FIG. 6 and are adapted to receive a pair of nails in their respective bores 56 to provide strong support for the heavy picture to be hung. The hanger member 46 is located in the same manner as previously described, namely by suspending it by means of hook 20 upon the ring 36 of locator member 14.

Figure 5:
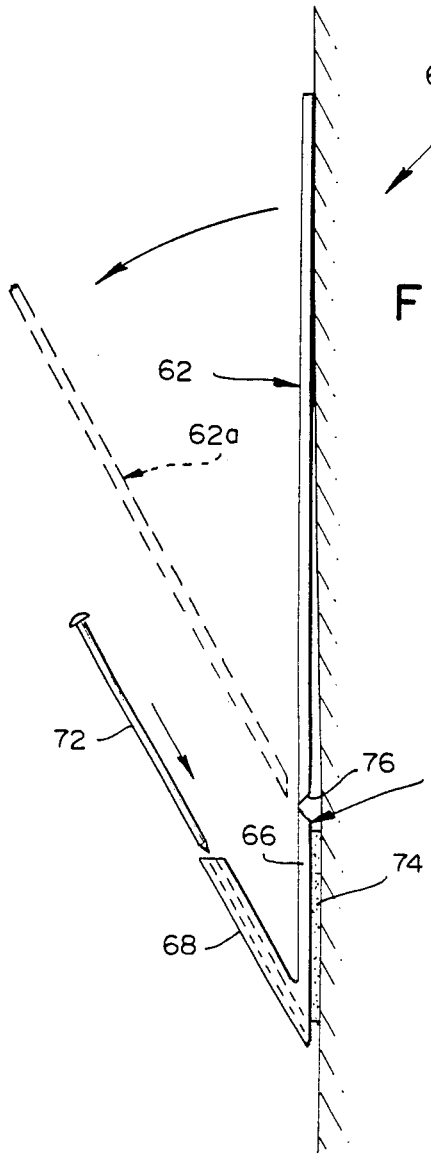
FIG. 5 is a side elevational view of the device shown in FIG. 4.

FIGS. 4 and 5 illustrate an alternative embodiment of hanger locator device 60 in which the separate locator member 14 is eliminated and the locator member 62 is made integral with, but detachable from, the hanger member 64. The hanger member 64 has a flat body plate 66 formed with integral nail chutes 68 at its opposite sides, which nail chutes are provided with bores 70 for receiving nails 72. The rear surface of the body plate 66 is again coated with a layer of pressure-sensitive adhesive 74. In this instance, the hanger member 64 is not provided with a top hook. The entire hanger locator device 60 is made of a rigid plastic with the locator member 64 molded integrally as a continuation of the flat body plate 66 and separated therefrom by a recessed transverse notch or score line 76.

The locator device 60 is employed in the same manner as previously described in connection with the device 10 for locating the picture hanger member 64 in a selected position. In use, a picture is hung from the hanger member 64 by suspending its picture wire on the nail chutes 68. The user then grasps the upper end of the locator member 64 and places it against the wall, moving it in various directions until the suspended picture frame is properly positioned on the wall. The picture frame is then pressed inwardly toward the wall until the hanger member engages the wall firmly and adheres thereto by means of the layer of pressure sensitive adhesive 74. The picture frame is then removed from the hanger member 64, and the latter is permanently secured to the wall by inserting nails 72 into the nail chutes 68 and hammering the nails into the wall. With the hanger member 64 thus securely mounted, the locator member 62 is detached therefrom by bending it forwardly away from the wall along the transverse notch 76, in the manner shown by the broken line representation **62*a* in FIG. 5**, so that it breaks off along said notch 76. The detached locator member may then be discarded, and the picture is then hung in properly mounted location upon the hanger member 64.

The hanger member 64 is shown in FIG. 4 as having a pair of nail chutes 68. It will be understood, however, that the hanger member 64 may be provided with a single nail chute in the same manner as the hanger member 12 of FIGS. 1 and 2.

While preferred embodiments of the invention have been shown and described herein, it will be appreciated that numerous omissions, changes and additions may be made in such embodiments without departing from the spirit and scope of the invention.

What is claimed is:

1. A device for positioning pictures and like articles in selected locations for hanging upon a wall, said device comprising:

a hanger member having a flat body plate and at least one nail chute projecting from the front surface of said body plate, said nail chute being sized and positioned to suspend therefrom a support member on the rear of the article to be hung, said nail chute being formed integrally with said hanger member, an elongated locator member having a length appreciably greater than the length of said hanger member, said elongated locator member being flexible, means for detachably coupling said locator member to the upper end of said hanger member with said locator member extending upwardly from said hanger member, whereby when said article to be hung is suspended on said hanger member, said locator member extends above the top of said article in a position to be grasped for locating said article in a selected position on said wall, and adhesive means on the rear surface of said body plate for temporary attachment of said hanger member on said wall in said selected position.

2. A device according to claim 1 in which said adhesive means is a layer of pressure-sensitive adhesive.

3. A device according to claim 1 in which said nail chute comprises a cylindrical projection extending angularly upward from the front surface of said body plate and having a bore extending therethrough.

4. A device according to claim 3 in which said hanger member has a single nail chute.

5. A device according to claim 3 in which said hanger member has a pair of nail chutes.

6. A device according to claim 1 in which said elongated locator member comprises a strap, and in which said coupling means comprises a ring mounted on said strap and a hook on said hanger member sized for insertion into said ring.

7. A device according to claim 6, wherein said hanger member further includes an inclined upper surface disposed above the hook.

8. A device according to claim 1 in which said locator member is formed integrally with said hanger member, and in which said detachable coupling means comprises a recessed transverse notch at the juncture of said locator member and hanger member.

9. A device according to claim 1 in which said locator member is formed integrally with said hanger member, and in which said detachable coupling means comprises a transverse score line at the juncture of said locator member and hanger member.

10. A device according to claim 1 in which said locator member is at least three times as long as said hanger member.

11. A device according to claim 1, wherein said hanger member further includes an inclined upper surface.

12. A device for positioning pictures and like articles in selected locations for hanging upon a wall, said device comprising:

a hanger member having a flat body plate and at least one nail chute projecting from the front surface of said body plate, said nail chute being sized and positioned to suspend therefrom a support member on the rear of the article to be hung, an elongated locator member having a length appreciably greater than the length of said hanger member, and being formed integrally with said hanger member, means for detachably coupling said locator member to the upper end of said hanger member with said locator member upstanding from said hanger member, whereby when said article to be hung is suspended on said hanger member, said locator member projects above the top of said article in a position to be grasped for locating said article in a selected position on said wall, said detachable coupling means including a transverse score line at the juncture of said locator member and said hanger member, and adhesive means on the rear surface of said body plate for temporary attachment of said hanger member on said wall in said selected position.

* * * * *